United States Patent [19]

Renner et al.

[11] Patent Number: 4,952,487

[45] Date of Patent: Aug. 28, 1990

[54] COLOR PHOTOGRAPHIC RECORDING MATERIAL

[75] Inventors: Günter Renner, Bergisch Gladbach; Johannes Sobel, Leverkusen; Klaus Wagner, Leverkusen; Günter Junkers, Leverkusen; Friedhelm Sommer, Leverkusen, all of Fed. Rep. of Germany

[73] Assignee: Agfa-Gevaert Aktiengesellschaft, Leverkusen, Fed. Rep. of Germany

[21] Appl. No.: 458,167

[22] Filed: Dec. 28, 1989

Related U.S. Application Data

[63] Continuation of Ser. No. 83,667, Aug. 7, 1987.

[30] Foreign Application Priority Data

Aug. 21, 1986 [DE] Fed. Rep. of Germany ..... 3628318

[51] Int. Cl.[5] ..... G03C 7/384

[52] U.S. Cl. ..... 430/546; 430/554; 430/555

[58] Field of Search ..... 430/546, 554, 555, 551

[56] References Cited

U.S. PATENT DOCUMENTS

| | | | |
|---|---|---|---|
| 2,835,579 | 5/1958 | Thirtle et al. | 430/546 |
| 4,346,165 | 8/1982 | Sawada et al. | 430/372 |
| 4,810,625 | 3/1989 | Wagner et al. | 430/546 |

*Primary Examiner*—Paul R. Michl
*Assistant Examiner*—Mark R. Buscher
*Attorney, Agent, or Firm*—Connolly and Hutz

[57] ABSTRACT

In combination with oil formers of the alkylphenol type, 3-anilinopyrazolones show absorption maxima displaced by about 8 to 12 nm towards longer wavelengths and a blue secondary absorption further displaced towards the UV range and, hence, a reduced yellow secondary density.

3 Claims, No Drawings

COLOR PHOTOGRAPHIC RECORDING MATERIAL

CROSS REFERENCE

This is a continuation of the copending application by Günter Renner, Johannes Sobel, Klaus Wagner, Günter Junkers, and Friedhelm Sommer, Ser. No. 07/083,667 filed Aug. 7, 1987, pending, entitled Color Photographic Recording Material.

This invention relates to a color photographic recording material comprising at least one photosensitive silver halide emulsion layer with which a pyrazolone magenta coupler and an oil former are associated.

It is known that color photographic images can be produced by chromogenic development, i.e. by developing a recording material comprising at least one silver halide emulsion layer, which has been exposed to form an image, in the presence of suitable color couplers using suitable dye-producing developer substances, the developer oxidation product formed in correspondence with the silver image reacting with the color coupler to form a dye image.

Compounds derived from 5-pyrazolone are generally used as magenta couplers, i.e. as color couplers suitable for producing the magenta dye image. Typical magenta couplers are, for example, 5-pyrazolone compounds which are substituted by an acylamino group in the 3-position. Couplers such as these are distinguished from 3-anilino-5-pyrazolone couplers by a narrow-banded absorption which leads to brilliant color reproductions, by low secondary densities both in the red and in the blue spectral region, by resistance to heat, tropical conditions and in-covered storage, by excellent light stability of the azomethine dyes formed with p-phenylenediamines and by high reactivity and coupling activity. Nevertheless, serious disadvantages exist where anilinopyrazolones are used in color negative and color reversal films because their absorption maxima are characteristically displaced towards shorter wavelengths compared with acylaminopyrazolones so that the materials in question show neither print compatibility nor duplicatability where standard reproduction equipment is used. Print compatability is understood to be the reproduction properties of a recording material on standard reproduction materials using standard printing equipment. In addition, there are doubts concerning the use of 3-anilinopyrazolones in recording materials on account of the increased graininess of the dyes formed.

Accordingly, the object of the present invention is to find a possibility of using 3-anilinopyrazolones where the disadvantages mentioned above do not arise, but where the advantageous properties remain intact.

It has now been found that this object can be achieved by using 3-anilinopyrazolones with alkylphenols as oil formers. Although alkylphenols have already been used as oil formers for magenta couplers, for example in U.S. Pat. No. 2;835 579 and in EP-OS No. 137 722, they have always been used in conjunction with 3-acylamino-5-pyrazolone compounds or with triazolopyrazoles, the use of alkylphenols as oil former affecting in particular the properties color density, formaldehyde stability and sensitivity. In particular, it is apparent from EP-OS No. 137 722 that an improvement in the properties mentioned is observed only in the case of triazolopyrazoles.

It was therefore surprising to find that the combination of 3-anilinopyrazoles with oil formers of the alkylphenol type leads to color photographic recording materials in which the dyes formed show a narrow half band width, absorption maxima displaced by about 8 to 12 nm towards longer wavelengths, a blue absorption further displaced towards the UV range and, hence, a reduced yellow secondary density and improved graininess for the same sharpness.

Accordingly, the present invention relates to a color photographic recording material comprising at least one photosensitive silver halide emulsion layer, with which are associated a 3-anilinopyrazolone coupler corresponding to the following general formula (I)

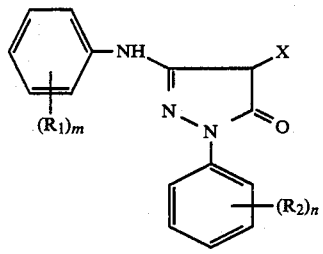

in which n=1 to 5, m=1 to 3, X represents a releasable group, $R_1$ represents halogen, alkoxy, alkylthio, acylamino and $R_2$ represents halogen, cyano, thiocyanato, alkoxy, alkyl, acylamino, alkoxycarbamyl, and, as oil former, a phenolic compound corresponding to the following general formula (II)

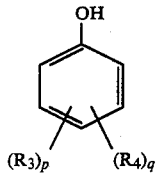

in which p=1 to 5, q=a number≦(5-p), $R_3$ represents alkyl or cycloalkyl and $R_4$ represents any substituent different from alkyl, the number of the carbon atoms in the alkyl radicals $R_3$ being≧8.

Suitable releasable groups X are, for example, hydrogen or a group releasable as anion by an alkali after the color coupling reaction, preferably an -S-aryl, -O-aryl, -NH-acyl, heterocyclyl, -N=N-aryl group.

Of these groups, -S-aryl and -N=N-aryl are particularly preferred, aryl representing in particular a phenyl or naphthyl radical optionally substituted by halogens, such as chlorine and bromine, $C_1$–$C_{18}$ alkyl, $C_1$–$C_{18}$ alkoxy.

Alkoxy $R_1$, $R_2$ and $R_5$ is in particular $C_1$–$C_{16}$ alkoxy. Acylamino $R_1$ and $R_2$ or as releasable group X preferably corresponds to the following formulae $$R_5-\overset{\overset{R_6}{|}}{CON}-, \text{ and } R_5-SO_2\overset{\overset{R_6}{|}}{N}-$$

where $R_5$ represents alkyl, aryl, alkoxy or aryloxy and $R_6$ represents hydrogen or $C_1$–$C_4$ alkyl.

Alkyl $R_2$, $R_3$ and $R_5$ is, in particular, $C_1$–$C_{16}$ alkyl; aryl and aryloxy $R_5$ are, in particular, phenyl and phenoxy. The alkoxycarbamyl radicals preferably have $C_1$–$C_{16}$ alkoxy groups.

Cycloalkyl $R_3$ is, in particular, $C_5$–$C_7$ cycloalkyl. $R_4$ preferably represents methoxy, cyclopentyloxy, cyclohexyloxy or chlorine.

Alkylthio $R_1$ is in particular $C_1$–$C_{16}$ alkyl thio.

Couplers and/or oil formers may be present in a layer adjacent the photosensitive silver halide emulsion layer, but are preferably incorporated in the photosensitive silver halide emulsion layer. Known methods for the incorporation of couplers and oil formers in the silver halide emulsion layer are described, for example, in U.S. Pat. No. 2,322,027.

The following are suitable 3-anilino-5-pyrazolone compounds:

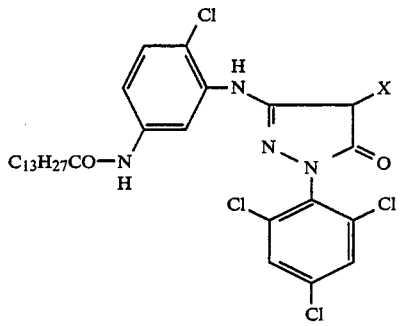

X = —H (M 1)

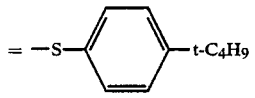

(M 2)

X = 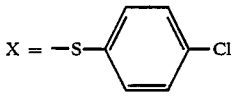

(M 3)

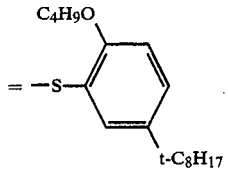

(M 4)

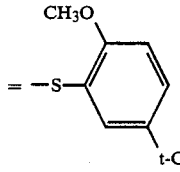

(M 5)

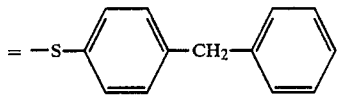

(M 6)

-continued

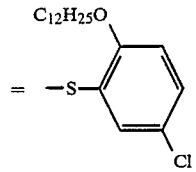

(M 7)

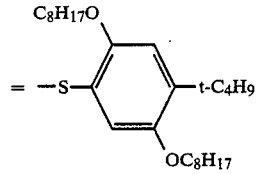

(M 8)

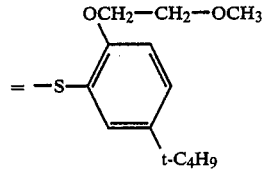

(M 9)

X = 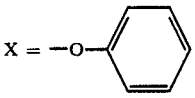

(M 10)

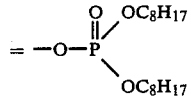

(M 11)

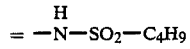

(M 12)

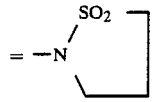

(M 13)

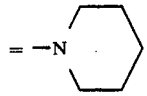

(M 14)

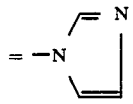

(M 15)

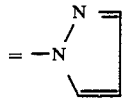

(M 16)

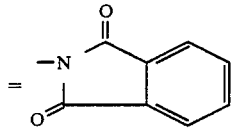

(M 17)

-continued
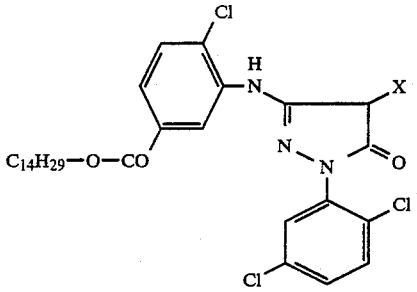
X = H (M 18)
(M 19)
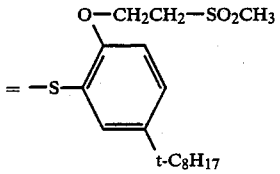
(M 20)
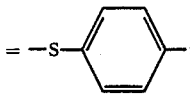
(M 21)
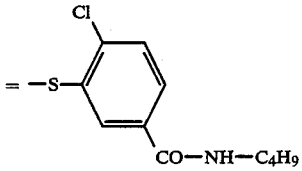
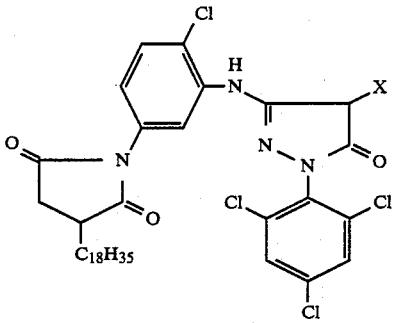
X = H (M 22)
(M 23)
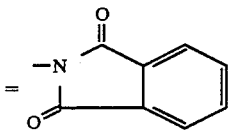
(M 24)
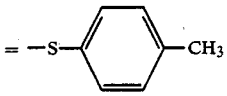
-continued
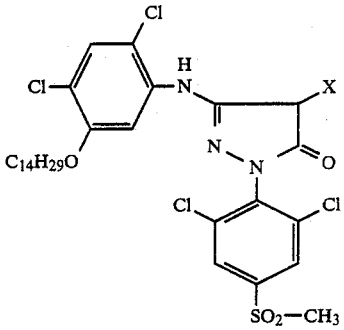
X = H (M 25)
(M 26)
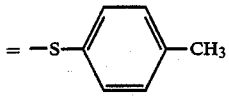
(M 27)
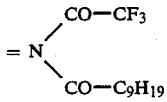
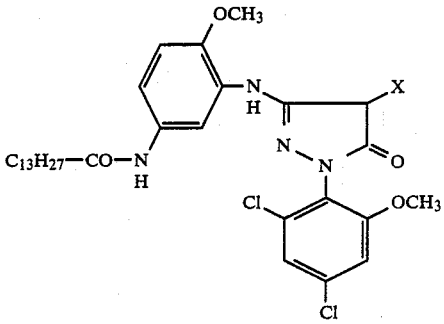
X = H (M 28)
(M 29)
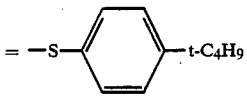
(M 30)
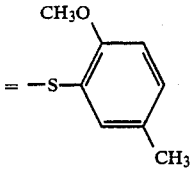
(M 31)
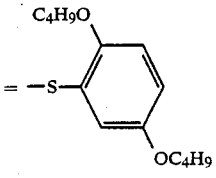

-continued
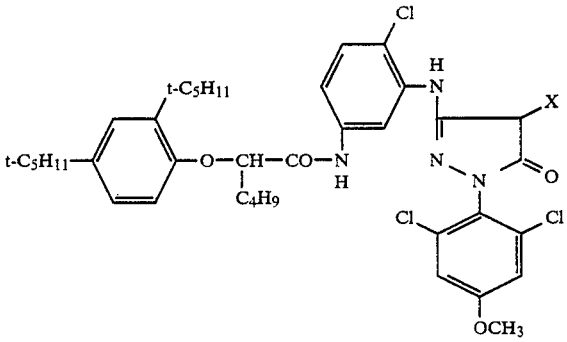
X = H (M 32)
= 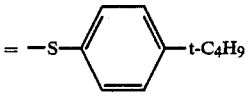 (M 33)
= 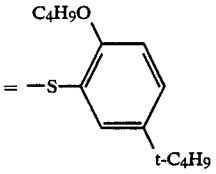 (M 34)
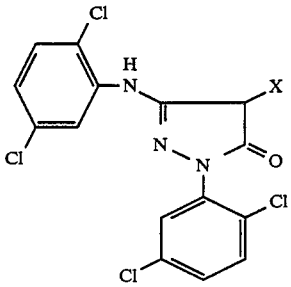
X = 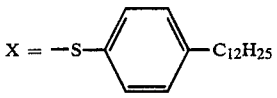 (M 35)
= $-S-C_{12}H_{25}$ (M 36)
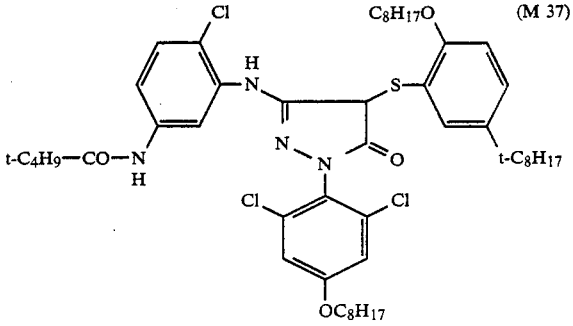
(M 37)
-continued
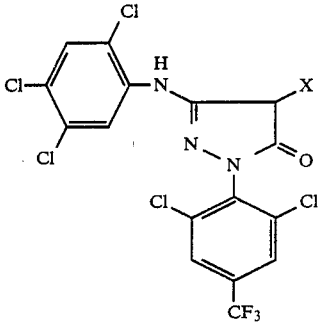
X = 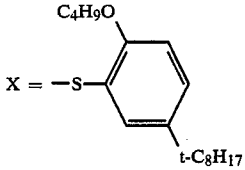 (M 38)
= 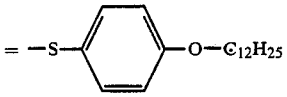 (M 39)
= 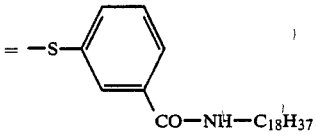 (M 40)
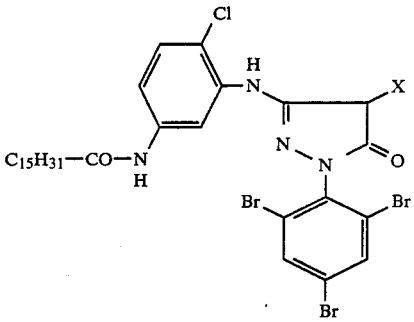
X = H (M 41)
= 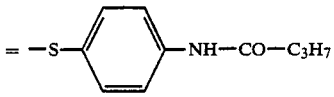 (M 42)
= 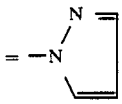 (M 43)

-continued
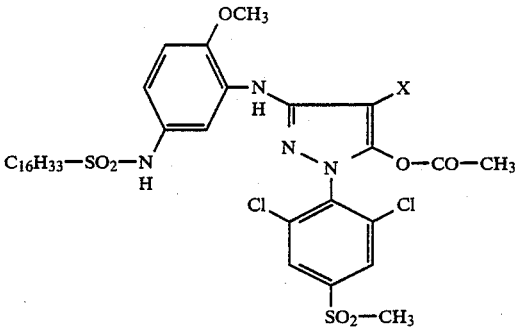
X = H (M 44)
(M 45)
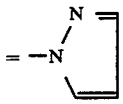
(M 46)
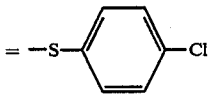
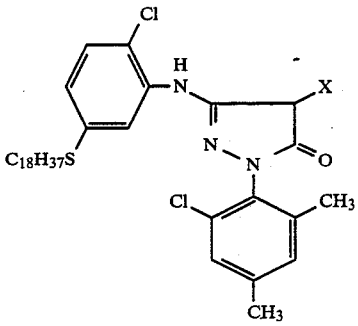
X = H (M 47)
(M 48)
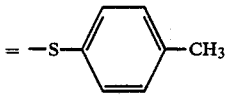
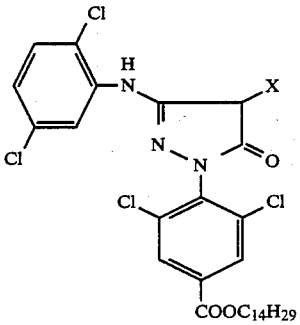
X = H (M 49)
(M 50)
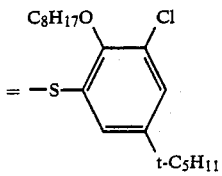
-continued
(M 51)
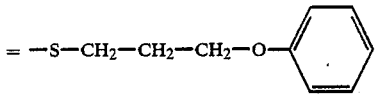
(M 52)
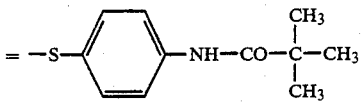
(M 53)
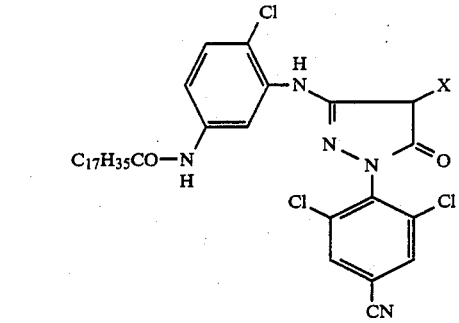
X = H (M 54)
(M 55)
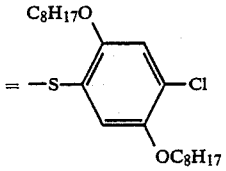
(M 56)
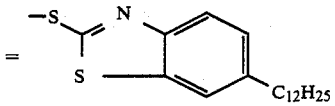
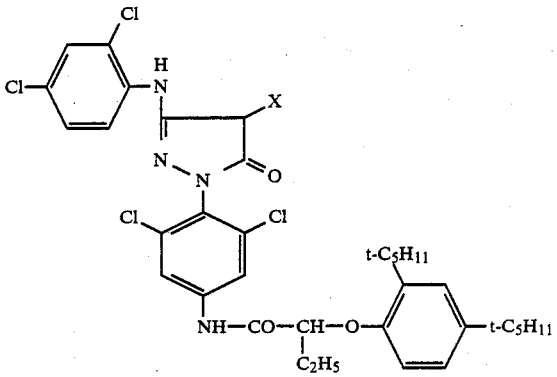
X = H (M 57)
(M 58)
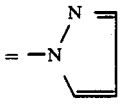
(M 59)
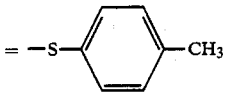

-continued
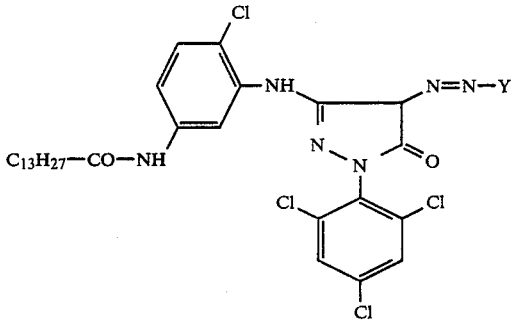
(M 60)
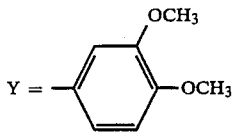
(M 61)
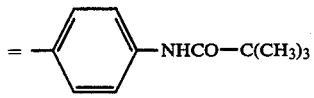
(M 62)
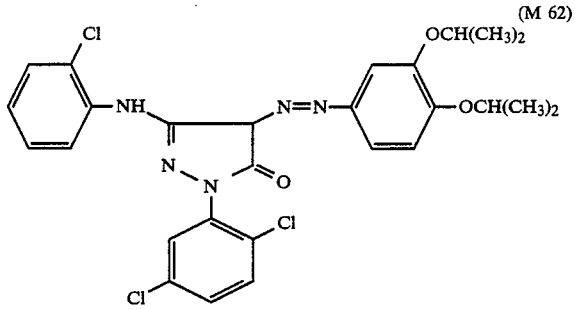
(M 63)
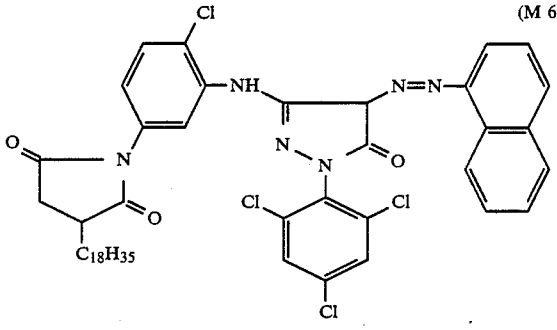
(M 64)
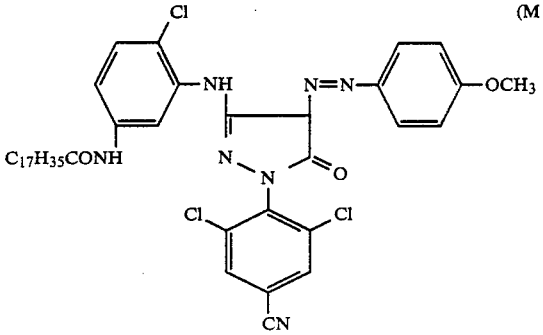
Suitable phenolic oil formers correspond to the following formulae
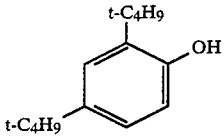
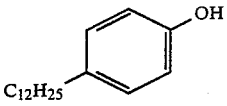
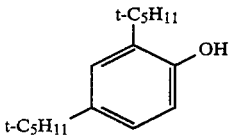
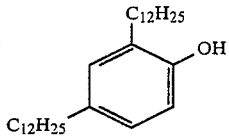
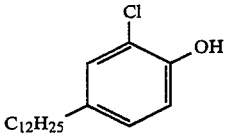
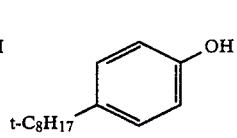
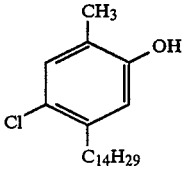
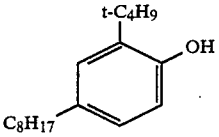
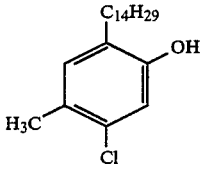
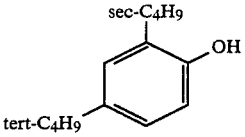
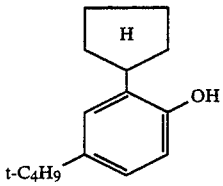
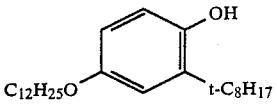
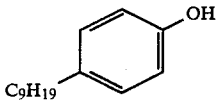
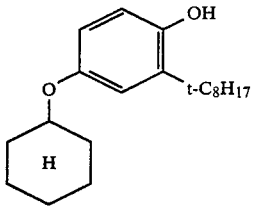
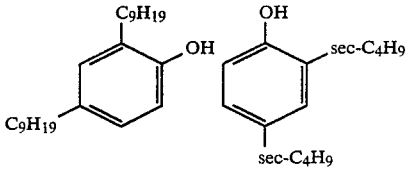
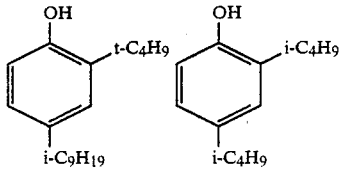

-continued

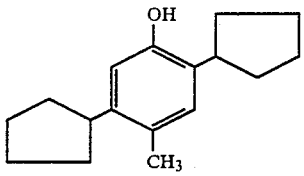

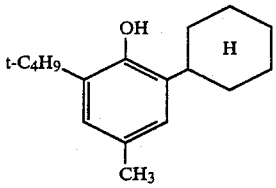

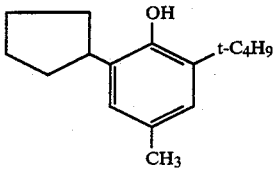

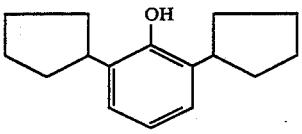

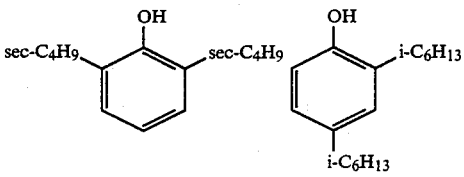

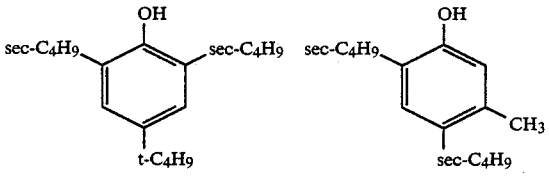

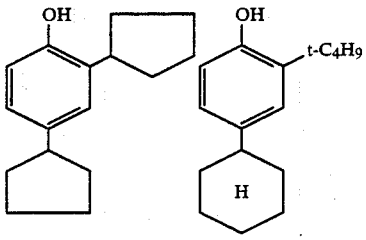

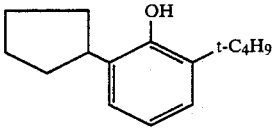

-continued

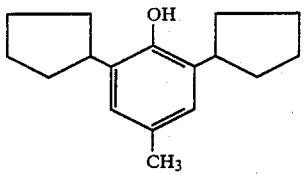

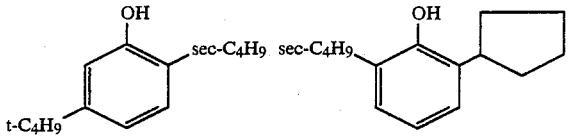

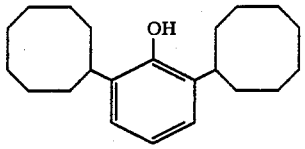

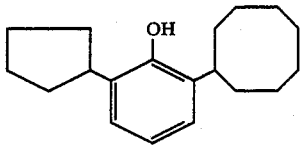

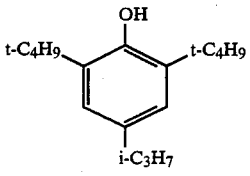

The color photographic recording material according to the invention contains at least one photosensitive silver halide emulsion layer and, preferably, a succession of several such photosensitive silver halide emulsion layers and, optionally, non-photosensitive binder layers arranged in between; according to the invention, a pyrazolone magenta coupler emulsified with an oil former according to the invention is associated with at least one of the photosensitive silver halide emulsion layers present.

The oil former according to the invention may be used either on its own or together with other known oil formers. However, if the magenta coupler is dissolved in a mixture of oil formers, more than 50% by weight of the mixture in question preferably consists of an oil former according to the invention.

The photosensitive silver halide emulsions used in the photosensitive layers may contain chloride, bromide and iodide or mixtures thereof as halide. For example, 0 to 12 mole % of the halide of at least one layer may consist of iodide, 0 to 50 mole % of chloride and 50 to 100 mole % of bromide. In certain embodiments, the crystals are predominantly compact crystals which are, for example, cubic or octahedral or have transitional forms. They may be characterized by the fact that they mostly have a thickness of greater than 0.2 μm. The average ratio of diameter to thickness is preferably less than 8 : 1, the diameter of a crystal being defined as the diameter of a circle with an area corresponding to the projected area of the crystal. In another embodiment, however, all the emulsions or individual emulsions may even contain substantially tablet-form silver halide crystals in which the ratio of diameter to thickness is greater than 8:1. The emulsions may be heterodisperse or even monodisperse emulsions which preferably have a mean grain size of 35 from 0.3 μm to 1.2 μm. The silver halide grains may even have a layered grain structure.

The emulsions may be chemically and/or spectrally sensitized in the usual way. They may also be stabilized by suitable additives. Suitable chemical sensitizers, spectral sensitizing dyes and stabilizers are described, for example, in Research Disclosure 17643 (December 1978), cf. in particular Chapters 111, IV and VI.

The color photographic recording material according to the invention preferably contains at least one silver halide emulsion layer for recording light of each of the three spectral regions, red, green and blue. To this end, the photosensitive layers are spectrally sensitized in known manner by suitable sensitizing dyes. Blue-sensitive silver halide emulsion layers do not necessarily have to contain a spectral sensitizer, because in many cases the natural sensitivity of the silver halide is sufficient for recording blue light.

Each of the photosensitive layers mentioned may consist of a single layer or, in known manner, for example as in the so-called double layer arrangement, may also comprise two or even more partial silver halide emulsion layers (DE-C-No. 1 121 470). Normally, red-sensitive silver halide emulsion layers are arranged nearer the layer support than green-sensitive silver halide emulsion layers which in turn are arranged nearer than blue-sensitive emulsion layers, a non-photosensitive yellow filter layer generally being arranged between the green-sensitive layers and blue-sensitive layers. However, other arrangements are also possible. A non-photosensitive intermediate layer, which may contain agents to prevent the unwanted diffusion of developer oxidation products, is generally arranged between layers of different spectral sensitivity. Where several silver halide emulsion layers of the same spectral sensitivity are present, they may be arranged immediately adjacent one another or in such a way that a photosensitive layer of different spectral sensitivity is present between them (DE-A-1 958 709, DE-A-2 530 645, DE-A-2 622 922).

Color photographic recording materials according to the invention normally contain color couplers for producing the different component dye images cyan, magenta and yellow in spatial and spectral association with the silver halide emulsion layers of different spectral sensitivity, the pyrazolone magenta couplers dispersed with the oil former according to the invention generally being associated with a green-sensitive silver halide emulsion layer.

In the context of the invention, spatial association means that the color coupler is present in such a spatial relationship to the silver halide emulsion layer that the two are capable of interacting in such a way as to allow imagewise accordance between the silver image formed during development and the dye image produced from the color coupler. This result is generally achieved by the fact that the color coupler is contained in the silver halide emulsion layer itself or in an adjacent, optionally non-photosensitive binder layer.

By spectral association is meant that the spectral sensitivity of each of the photosensitive silver halide emulsion layers and the color of the component dye image produced from the particular spatially associated color coupler bear a certain relationship to one another, a component dye image relating to another color (generally for example the colors cyan, magenta or yellow in that order) being associated with each of the spectral sensitivities (red, green, blue).

One or more color couplers may be associated with each of the differently spectrally sensitized silver halide emulsion layers. Where several silver halide emulsion layers of the same spectral sensitivity are present, each of them may contain a color coupler, the color couplers in question not necessarily having to be the same. They are merely required to produce at least substantially the same color during color development, normally a color which is complementary to the color of the light to which the silver halide emulsion layers in question are predominantly sensitive.

In preferred embodiments, therefore, at least one non-diffusing color coupler for producing the cyan component dye image, generally a coupler of the phenol or α-naphthol type, is associated with red-sensitive silver halide emulsion layers. At least one non-diffusing color coupler for producing the magenta component dye image is associated with green-sensitive silver halide emulsion layers, other magenta couplers, for example of the indazolone or pyrazoloazole type, optionally being used in addition to the pyrazolone magenta coupler used in accordance with the invention. Finally, at least one non-diffusing color coupler for producing the yellow component dye image, generally a color coupler containing an open-chain ketomethylene group, is associated with blue-sensitive silver halide emulsion layers. Color couplers of this type are known in large numbers and are described in a number of patent specifications. Reference is made here for example to the publications "Farbkuppler (Color Couplers)" by W. Pelz in "Mitteilungen aus den Forschungslaboratorien der Agfa, Leverkusen/Munchen", Vol. III, page 111 (1961) and by K. VENKATARAMAN in "The Chemistry of Synthetic Dyes", Vol. 4, 341 to 387, Academic Press (1971).

The color couplers according to the invention and the other color couplers present in the color photographic recording material may be both typical 4-equivalent couplers and also 2-equivalent couplers in which a smaller quantity of silver halide is required for dye production. 2-equivalent couplers are known to be derived from the 4-equivalent couplers in that they contain in the coupling position a substituent which is eliminated during the coupling reaction. 2-equivalent couplers include both those which are substantially colorless and also those which have a strong color of their own which either disappears during the color coupling reaction or is replaced by the color of the image dye produced. Couplers of the latter type may also be additionally present in the photosensitive silver halide emulsion layers where they serve as masking couplers for compensating the unwanted secondary densities of the image dyes. However, 2-equivalent couplers also include the known white couplers, although couplers such as these do not produce a dye on reaction with color developer oxidation products 2-equivalent couplers also include couplers which contain in the coupling position a releasable group which is released on reaction with color developer oxidation products and, in the process, develops a certain, desirable photographic activity, for example as a development inhibitor or accelerator. Examples of 2-equivalent couplers such as these are the known DIR couplers and also DAR and FAR couplers. The releasable group may also be a ballast group, so that coupling products, for example dyes, which are diffusible or which at least show slight or limited mobility are obtained during the reaction with color developer oxidation products.

By slight or limited mobility is meant a mobility which is gauged in such a way that the contours of the discrete dye patches formed during chromogenic development blend and merge with one another. This degree of mobility should be distinguished, on the one hand, from the usual case of complete immobility in photographic layers which, in conventional photographic recording materials, is required for the color couplers or rather for the dyes produced therefrom in order to obtain maximal definition and, on the other hand, from the case of total mobility of the dyes as required, for example, in dye diffusion processes. The extent of the slight mobility required in accordance with the invention may be controlled by varying substituents in order, for example, specifically to influence solubility in the organic medium of the oil former or affinity for the binder matrix.

Suitable layer supports for the recording materials according to the invention are the usual types, for example supports of cellulose esters, for example cellulose acetate, and of polyesters. Other suitable layer supports are paper supports which may optionally be coated, for example with polyolefins, particularly with polyethylene or polypropylene. Reference is made in this connection to Research Disclosure 17643, Chapter XVII.

Suitable protective colloids or binders for the layers of the recording material are the usual hydrophilic film-forming agents, for example proteins, particularly gelatin. Casting aids and plasticizers may be used, cf. Research Disclosure 17643, Chapters IX, XI and XII.

The layers of the photographic material may be hardened in the usual way, for example with hardeners containing at least two reactive oxirane, aziridine or acryloyl groups. The layers may also be hardened by the process described in DE-A-22 18 009. The photographic layers or rather the color photographic multilayer materials may also be hardened with hardeners of the diazine, triazine or 1,2-dihydroquinoline series or with hardeners of the vinyl sulfone type. Other suitable hardeners are known from DE-A-24 39 551, DE-A-22 25 230, DE-A-24 39 551 and from Research Disclosure 17643, Chapter X. The stabilizing effect of the oil formers according to the invention is particularly pronounced when hardeners activating carboxyl groups, for example carbamoyl pyridinium or carbamoyloxy pyridinium salts, are used.

Other suitable additives are described in Research Disclosure 17643 and in "Product Licensing Index", December 1971, pages 107–110.

Suitable color developers for the material according to the invention are, in particular, those of the p-phenylenediamine type, for example 4-amino-N,N-diethyl aniline hydrochloride, 4-amino-3-methyl-N-ethyl-N-β-(methane sulfonamido)-ethyl aniline sulfate hydrate, 4-amino-3-methyl-N-ethyl-N-β-hydroxyethyl aniline sulfate, 4-amino-N-ethyl-N-(2-methoxyethyl)-m-toluidine di-p-toluene sulfonic acid and N-ethyl-N-β-hydroxyethyl-p-phenylenediamine. Other suitable color developers are described, for example, in J. Amer, Chem. Soc. 73, 3100 (1951) and in G. Haist, Modern Photographic Processing, 1979, John Wiley and Sons, New York, pages 545 et seq.

After color development, the material is bleached and fixed in the usual way. Bleaching and fixing may be carried out separately from one another or even in conjunction with one another. Suitable bleaching agents are the usual compounds, for example $FE^{3+}$ salts and $Fe^{3+}$ complex salts, such as ferricyanides, dichromates, water-soluble cobalt complexes, etc. Particularly preferred bleaching agents are iron(III) complexes of aminopolycarboxylic acids, in particular for example ethylenediamine tetraacetic acid, nitrilotriacetic acid, iminodiacetic acid, N-hydroxyethyl ethylenediamine triacetic acid, alkyliminodicarboxylic acids and of corresponding phosphonic acids. Persulfates are also suitable bleaching agents.

EXAMPLE 1

General Procedure for dispersion

A solution of 100 g coupler, 45 g oil former (tricresyl phosphate or phenols according to the invention or mixtures thereof), 200 g ethyl acetate and 2 g sodium dodecylbenzene sulfonate is stirred into 1 liter of a 10% by weight gelatin solution at 45° C. using an intensive stirrer. After stirring for 5 minutes, the mixture is passed through a high-pressure homogenizer (Knollenberg) or through an ultrasonic homogenizer (Sonic) and the ethyl acetate separated off by evaporation in vacuo.

The dispersions thus prepared show excellent stability in storage both at low temperatures (4° to 10° C.) and at high temperatures (for example 40° C.) without any deposition of crystals or coarse particles.

DISPERSION EXAMPLES

Prepared by the general procedure

TABLE 1

| | Coupler | Oil former | Stability* after storage at 40° C. (in days) | Mean** particle size (in μm) |
|---|---|---|---|---|
| A | C 1 | tricresyl phosphate (TCP) | 4 | 0.35 |
| B | C 2 | dibutyl phthalate (DBP) | 7 | 0.30 |
| C | M 1 | tricresyl phosphate | 7 | 0.42 |
| D | M 1 | 2,4-di-tert.-amylphenol (1) | 9 | 0.32 |
| E | M 4 | di-tert.-butyl-phenol (2) | 7 | 0.35 |
| F | M 2 | p-isononyl-phenol (3) | 8 | 0.39 |
| G | M 30 | di-isohexyl-phenol (4) | 7 | 0.38 |

*Stability test: The dispersion is stored at 40° C. and examined under a microscope for the presence of crystals or coarse particles. The result of the stability test is expressed as the time in days for which the dispersion remains free from crystals and coarse particles.

**Determination of particle size: The mean particle size was determined by laser correlation spectroscopy using a Coulter Nanosizer (Coulter Electronics, Hialeah, Florida, USA). This instrument determines the so-called hydrodynamic diameter of dispersed particles in heavy dilution.

Comparison couplers C 1 and C 2 have the following structure (acylaminopyrazolones):

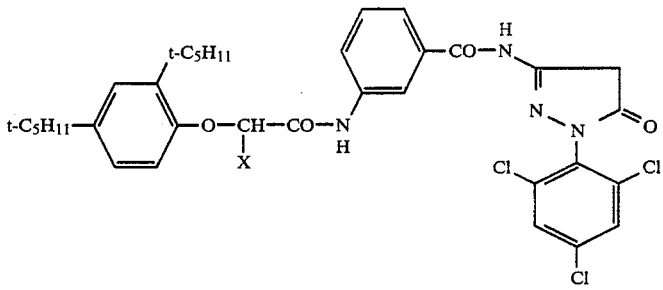

C1: X = H
C2: X = $C_2H_5$

EXAMPLE 2

To prepare the multilayer materials, the following layers were applied in the order indicated to a transparent layer support of cellulose triacetate.

All the quantities are based on 1 $m^2$. For the silver applied, the corresponding quantities of $AgNO_3$ are indicated. All the silver halide emulsions of the described materials were stabilized with 0.5 g 4-hydroxy-6-methyl-1,3,3*a*,7-tetraazindene per 100 g $AgNO_3$.

1st layer: (antihalo layer)
Black colloidal silver sol containing 1,5 g gelatin and 0.33 g Ag.

2nd layer: (intermediate layer)
0.6 g gelatin

3rd layer:(silver halide emulsion layer)
The third layer contained 2.5 g of an Ag(Br,I) emulsion containing 3 mole % iodide, mean grain diameter=0.45 μm, and 2.25 g gelatin. This 3rd layer also contained 2.0 g magenta coupler emulsified in 0.9 g oil former according to Table 2.

4th layer (protective layer)
1.2 g gelatin

5th layer:(hardening layer)
1.5 g gelatin
0.7 g of a standard hardener.

The materials were exposed to white light behind a step wedge and then subjected to standard color reversal development (cf. Example 2 of EP-A-62 202).

The absorption curves of the magenta dyes formed with the following developer

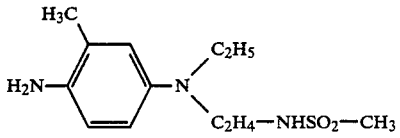

were measured.

A parallel displacement of the absorption curves dependent upon the oil former content of oil formers 2, 3 or 4 was surprisingly observed.

TABLE 2

Displacement of the absorption maximum of coupler M 1 by phenol derivatives

| Sample no. | Dispersion coupler: | Dispersion oil former: | Absorption maximum at $\lambda_{max}$ [nm] | Secondary density $\lambda_{max}$ [nm] |
|---|---|---|---|---|
| 1 | M 1 | TCP | 539 | 429 |
| 2 | M 1 | TCP/(1) 2:1 | 544 | 427 |
| 3 | M 1 | TCP/(1) 1:2 | 547 | 426 |
| 4 | M 1 | (1) | 548 | 424 |

TABLE 2-continued

Displacement of the absorption maximum of coupler M 1 by phenol derivatives

| Sample no. | Dispersion coupler: | Dispersion oil former: | Absorption maximum at $\lambda_{max}$ [nm] | Secondary density $\lambda_{max}$ [nm] |
|---|---|---|---|---|
| 5 | M 1 | (3) | 547 | 426 |
| 6 | M 1 | (3)/TCP 2:1 | 545 | 431 |
| 7 | M 1 | (3)/TKP 1:2 | 544 | 430 |
| 8 | M 1 | (5)* | 546 | 425 |
| 9 | C 1 | TCP | 548 | 434 |
| 10 | C 2 | TCP | 550 | 434 |

All dispersions were prepared with a coupler:gelatin:oil former ratio of 1:1:0;45.
*Oil former (5) is o,p-diisononylphenol. For the other oil formers, see page 29.

Explanation of samples 1–10:

Whereas the main maximum of sample 1 is displaced from 539 to 547 nm into the desired position of the absorption maximum by using phenols according to the invention (sample 4), the blue secondary density is displaced in the opposite direction from 429 to 424 nm; i.e. both bands continue diverging from one another, which is of relevance above all in the measurement of the integral color densities. This explains the improved color reproduction where anilinopyrazolones are used with phenols instead of tricresyl phosphate/dibutyl phthalate. Against comparison samples 9 and 10, the differences are even more serious. At $\lambda_{max}$=548 nm, the secondary maximum lies at ~434 nm for distinctly increased extinction. Correlation of these values to visual sensitivity, which is distinctly reduced at 424 nm as against 434 nm, significantly increases the difference ("visible secondary density").

The improved absorption also becomes clear from observation of the half band widths of samples 4, 8, 9 and 10, amounting to 82–83 nm in the case of samples 4 and 8 and to 86 and 90 nm, respectively, in the case of samples 9 and 10.

The same samples were subjected to standard color negative processing (Kodak's Flexicolor process). The dyes obtained with the following developer

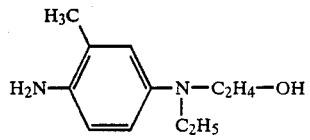

show the absorptions indicated in the Table 3 below; hence comparable advantages.

TABLE 3

| Sample | Absorption maximum $\lambda_{max}$ [nm] | Secondary density $\lambda_{max}$ [nm] |
|---|---|---|
| 1 | 542 | 430 |
| 2 | 545 | 428 |
| 3 | 548 | 426 |
| 4 | 552 | 424 |
| 5 | 551 | 425 |
| 6 | 547 | 426 |
| 7 | 544 | 427 |
| 8 | 552 | 423 |
| 9 | 552 | 435 |
| 10 | 553 | 436 |

EXAMPLE 3

A color photographic recording material for reversal color development was prepared by applying the following layers in the order indicated to a transparent layer support of cellulose triacetate. All the quantities are based on 1 $m^2$. For the silver applied, the corresponding quantities of $AgNO_3$ are indicated.

Layer 1:(antihalo layer)

Black colloidal silver sol containing 1.5 g gelatin and 0.33 g Ag

Layer 2:(intermediate layer)

0.6 g gelatin

Layer 3:(first red-sensitized layer)

Red-sensitized silver bromide iodide emulsion (3.5 mole % iodide; mean grain diameter 0.22 μm) containing 0.98 g $AgNO_3$, 0.81 g gelatin and 0.46 mmole cyan coupler corresponding to the following formula

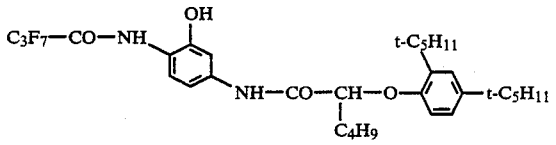

Layer 4:(second red-sensitized layer)

Red-sensitized silver bromide iodide emulsion (4.8 mole % iodide; mean grain diameter 0.6 μm) containing 0.85 g. $AgNO_3$, 0.73 gelatin and 1.04 mmole of the cyan coupler contained in layer 3.

Layer 5:(intermediate layer)

2 g gelatin and 0.15 g 2,5-di-tert.-octyl hydroquinone

Layer 6:(first green-sensitized layer)

Green-sensitized silver bromide iodide emulsion (4.3 mole % iodide; mean grain diameter 0.28 μm) containing 0.85 g $AgNO_3$, 0.75 g gelatin and 0.43 mmole magenta coupler.

The magenta coupler is used in the form of a dispersion, Table 3 showing the type of coupler used and also the type and quantity of oil former used.

Layer 7:(second green-sensitized layer)

Green-sensitized silver bromide iodide emulsion (3.8 mole % iodide; mean grain diameter 0.62 μm) containing 1.03 g $AgNO_3$, 0.89 g gelatin and 0.91 mmole magenta coupler.

As in layer 6, the magenta coupler is used in the form of a dispersion, Table 3 showing the type of coupler used and also the type and quantity of oil former used.

Layer 8:(intermediate layer)

1.2 g gelatin and 0.12 g 2,5-di-tert.-octyl hydrdoquinone.

Layer 9:(yellow filter layer)

Yellow colloidal silver sol containing 0.2 g Ag and 0.9 g gelatin

Layer 10:(first blue-sensitized layer)

Blue-sensitized silver bromide iodide emulsion (4.9 mole % iodide; mean grain diameter 0.35 μm) containing 0.76 g $AgNO_3$, 0.56 g gelatin and 0.53 mmole yellow coupler corresponding to the following formula

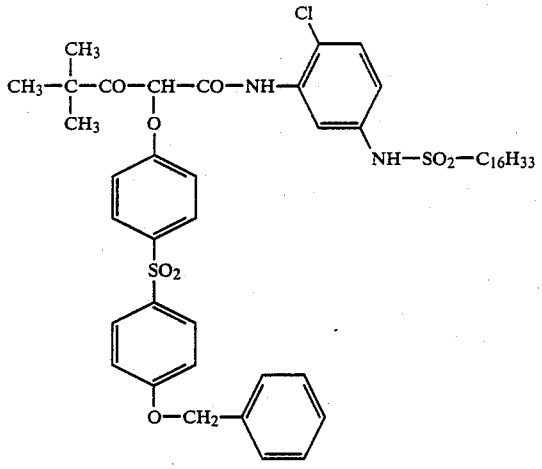

Layer 11:(second blue-sensitized layer)

Blue-sensitized silver bromide iodide emulsion (3.3 mole % iodide; mean grain diameter 0.78 μm) containing 1.30 g $AgNO_3$, 0.76 g gelatin and 1.62 mmoles of the yellow coupler present in layer 10.

Layer 12:(protective layer)

1.2 g gelatin

Layer 13:(hardening layer)

1.5 g gelatin and 0.7 g of a hardener corresponding to the following formula

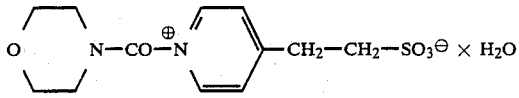

Seven different versions of the photographic recording material of the described multilayer material were prepared, differing only in the type of magenta coupler used and in the type and quantity of oil former used in layers 6 and 7.

Table 4 provides particulars of the combinations of magenta coupler and oil former according to the invention used in layers 6 and 7 of the described versions and of the ratios by weight of oil former.

A is a Comparison Test.

Oil former 6:

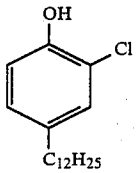

-continued

Oil former 7:

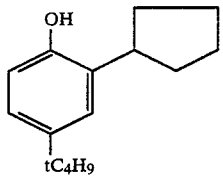

Oil former 8:

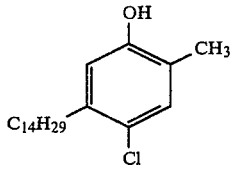

TABLE 4

| | Layer 6 | | Layer 7 | |
|---|---|---|---|---|
| | Coupler | Oil former | Coupler | Oil former |
| A | C 1 | 0.28 g TCP | C 1 | 0.6 g TCP |
| B | M 1 | 0.12 g (1) | M 1 | 0.25 g (1) |
| C | M 55 | 0.06 g TCP<br>0.12 g (6) | M 55 | 0.13 g TCP<br>0.26 g (69) |
| D | M 4 | 0.15 g (1)<br>0.06 g (6) | M 4 | 0.25 g (1)<br>0.08 g (6) |
| E | M 2 | 0.15 g (1) | M 2 | 0.15 g (6) |
| F | M 1 | 0.12 g (1) | M 2 | 0.15 g (8) |
| G | M 33 | 0.22 g (7) | M 4 | 0.25 g (1) |

One sample of each material was exposed to red light behind a step wedge and then developed by the color reversal processing cycle described in "The British Journal of Photography", 1981, pages 889, 890, 910, 911 and 919.

After densitometric measurement behind the 3 status A color filters red, green and blue, the following color densities were measured for a selected density stage:

| | Red | Green | Blue |
|---|---|---|---|
| Version A | 0.62 | 3.55 | 3.74 |
| B | 0.48 | 3.49 | 3.59 |
| C | 0.49 | 3.51 | 3.58 |
| D | 0.51 | 3.56 | 3.58 |
| E | 0.53 | 3.61 | 3.60 |
| F | 0.48 | 3.47 | 3.57 |
| G | 0.49 | 3.53 | 3.56 |

The cyan density value measured behind the red filter results from the residual secondary density of the pp-dye formed because co-coupling of the cyan component in layers 3 and 4 is ruled out by the presence of the 2,5-di-tert -octyl hydroquinone.

If, now, the measured cyan component is standardized to the measured pp-primary density in accordance with the following formula:

$$\frac{\text{cyan density}}{\text{magenta density}} \times 100 = \%\ \text{cyan secondary density}$$

The values for versions A to G work as follows:

| | | |
|---|---|---|
| Version A | 17.46% | cyan secondary density in the red |
| B | 13.75% | |
| C | 13.96% | |
| D | 14.33% | |
| E | 14.68% | |
| F | 13.83% | |
| G | 13.88% | |

Compared with Comparison test A (prior art), lower percentage cyan secondary densities and, hence, distinctly improved red reproduction are obtained in all the versions containing the coupler-oil former dispersions according to the invention.

The same also applies to the percentage yellow secondary density on exposure to blue light.

We claim:

1. A colour photographic recording material comprising at least one photosensitive silver halide emulsion layer with which is associated a 3-anilinopyrazolone coupler dissolved in an oil former or a mixture of oil formers, wherein said 3-anilinopyrazolone coupler corresponds to the following formula:

(I)

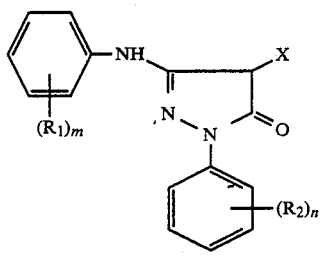

in which n=1 to 5, m=1 to 3, X represents a releasable group, $R_1$ represents halogen, alkoxy, alkylthio, acylamino and $R_2$ represents halogen, cyano, thiocyano, alkoxy, alkyl, acylamino, alkoxycarbamyl and wherein said oil former, or more than 50% by weight of said mixture of oil formers, consists of a phenolic compound, in the case of said mixture of oil formers the balance being other known oil formers, wherein said phenolic compound has one of the following formulae:

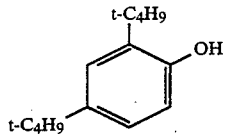

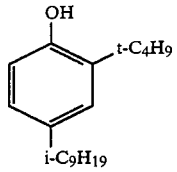

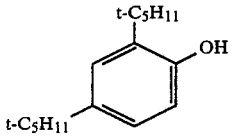

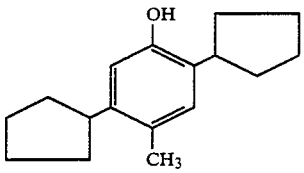

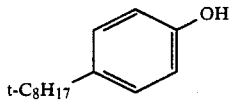

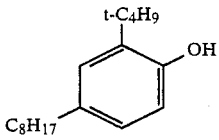

-continued

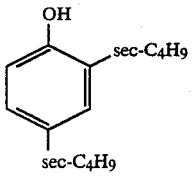

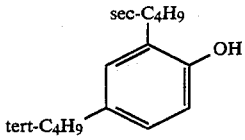

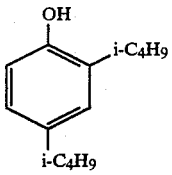

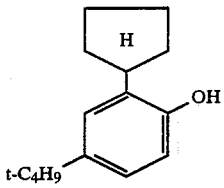

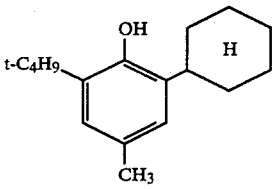

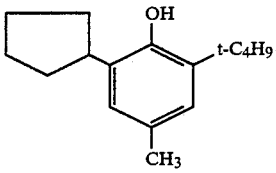

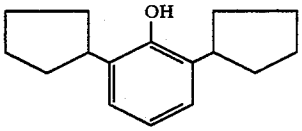

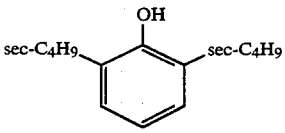

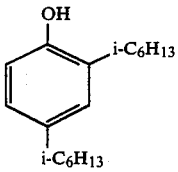

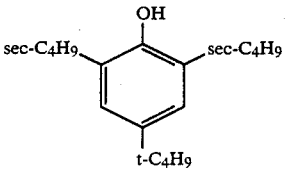

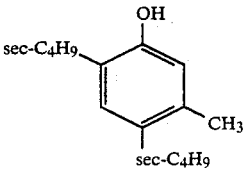

-continued

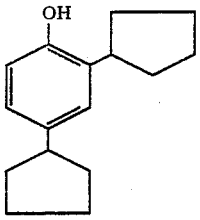

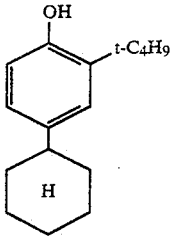

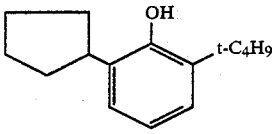

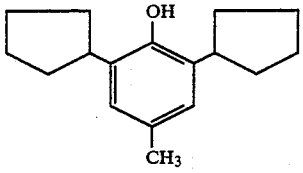

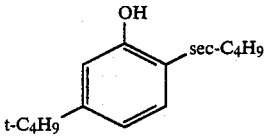

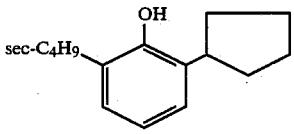

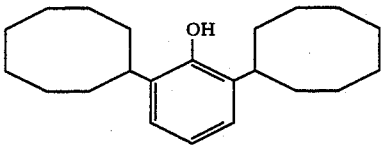

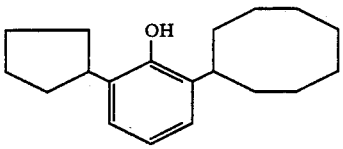

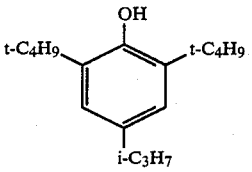

2. A color photographic recording material as claimed in claim 1, characterized in that the coupler and oil former are present in the photosensitive silver halide emulsion layer.

3. A color photographic recording material as claimed in claim 1, wherein X is hydrogen, -S-aryl, -O-aryl, -NH-acyl, heterocyclyl or -N=N-aryl group, $R_1$ is halogen, $C_1$–$C_{16}$-alkoxy, $C_1$–$C_{16}$-alkylthio or is $$R_5-\overset{\overset{R_6}{|}}{CON}- \quad \text{or} \quad R_5-\overset{\overset{R_6}{|}}{SO_2N}-$$

wherein $R_5$ is alkyl, aryl, alkoxy or aryloxy and $R_6$ is hydrogen or $C_1$–$C_4$-alkyl.

* * * * *